United States Patent [19]

Kenney

[11] 4,419,720

[45] Dec. 6, 1983

[54] TROUBLE LAMP

[76] Inventor: Theodore W. Kenney, 13239 Lupine, Trona, Calif. 93562

[21] Appl. No.: 308,982

[22] Filed: Oct. 6, 1981

[51] Int. Cl.[3] ..... F21V 7/00

[52] U.S. Cl. ..... 362/285; 362/296; 362/351; 362/353; 362/359; 362/361; 362/372; 362/376; 362/378; 362/396; 362/418; 362/429

[58] Field of Search ..... 362/396, 429, 376, 377, 362/378, 188, 285, 296, 351, 353, 359, 361, 372, 418, 429

[56] References Cited

U.S. PATENT DOCUMENTS

| | | | |
|---|---|---|---|
| 2,188,129 | 1/1940 | Ayotte | 362/188 |
| 2,282,167 | 5/1942 | Cullman | 362/188 |
| 2,861,175 | 11/1958 | Schweikle | 362/296 |
| 4,180,850 | 12/1979 | Bivens | 362/372 |
| 4,250,491 | 2/1981 | Dotson | 362/188 |
| 4,275,435 | 6/1981 | Dorn | 362/396 |

*Primary Examiner*—Stephen J. Lechert, Jr.
*Assistant Examiner*—Howard J. Locker
*Attorney, Agent, or Firm*—Gerald F. Baker

[57] ABSTRACT

A trouble lamp is constructed to provide a sliding movement between a light bulb and a reflector shield with slip friction fit between parts such that they may be manually positioned to provide the quality and amount of light desired by the operator.

1 Claim, 2 Drawing Figures

TROUBLE LAMP

BRIEF SUMMARY OF THE INVENTION

The present invention relates to electrical illumination means and, more specifically, to the kind of illumination means commonly known as a trouble lamp. The lamp is generally used by car owners and mechanics when working on an automobile, for example, under conditions where illumination is needed to facilitate the visual perception of the area to be worked upon.

Lamps of this kind in general use today are of a fixed nature and normally having a fixed shield around a portion of a light globe and a wire protector covering the unshielded portion of the globe.

According to the present invention there is provided means to shift the position of the globe and shield so that in one position the globe is practically surrounded by the shield such that only a narrow beam of light is projected through a round opening straight above the lamp to prevent light from shining in the eyes, for example, when the operator is concentrating on a small area of the work. The globe may be moved from the fully shielded position to a fully extended position when desired.

When the globe is in its fully extended position, the maximum amount of light spills into the desired work space but may be directed still by the positioning of the shield such that the greater part of the shield is in the desired position.

The positioning of the globe is accomplished by the cooperation of an inner insulated globe holder and an outer insulated shield holder being fitted together with an amount of slip friction which permits one of the parts to be positioned at any position between maximum or flooded illumination and minimum or spot illumination as desired.

An example of the prior art is seen in a U.S. Pat. No. 2,861,175 issued Nov. 18, 1958 to O. W. Schweikle. The adjustment of the amount of light emanating from the side of the lamp holder was accomplished by the rotation of two concentric cylindrical shade members. Proper operation of the adjustment means depended entirely upon the maintainance of the integrity of the cylindrical shade members, a condition which is most unlikely in the environment of its intended use. A single dent in the side of the light guard and reflector combination would greatly impair its usefulness and successive dents would render it practically useless for its intended purpose.

It is, therefore, an object of the present invention to provide an adjustable lamp holder of rugged construction and reliable operation and which may be easily and inexpensively manufactured.

Other and further objects and advantages of this invention will become more apparent from a consideration of the following specification when read in conjunction with the accompanying drawing.

DETAILED DESCRIPTION

Figure 1:
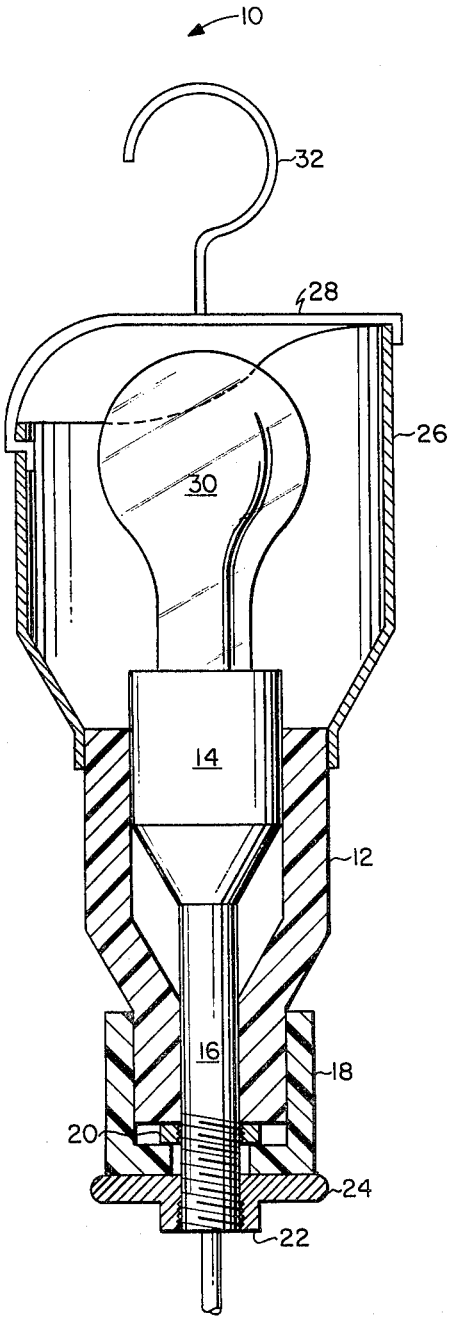
FIG. 1 is a longitudinal cross-sectional view of a lamp holder embodying features of the present invention and showing the device in the fully extended position.
Figure 2:
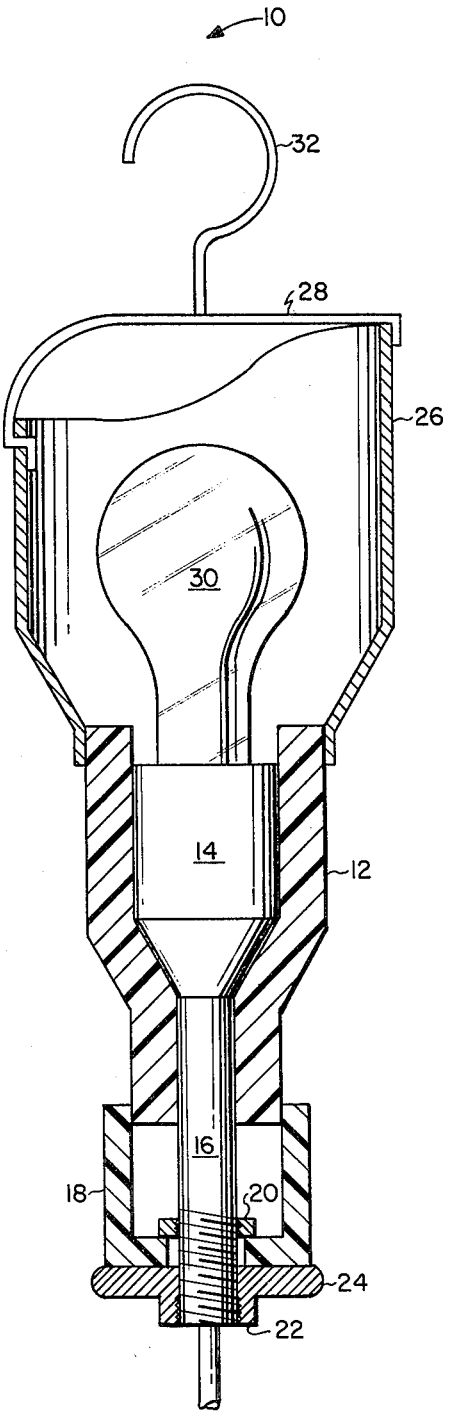
FIG. 2 is a view similar to FIG. 1 with the device in the fully retracted position.

Trouble lamp 10 depicted in FIGS. 1 and 2 comprises a hollow body 12 within which is mounted a light socket 14 and depending conduit tube 16. The body and the socket are preferably made of a resilient non-conductive material and fitted together with a slip friction therebetween which will allow the parts to be manually position and yet resist accidental movement from the position selected.

For relative movement of the parts, a cup shaped extension member 18 is provided to fit the end of body 12 opposite the light socket 14 and to be attached to the respective end of the conduit tube 16. For this latter purpose the end of conduit 16 is threaded and receives an inner nut 20 and an outer nut 22.

Cup shaped extension member 18 has a hole in the bottom thereof which receives the threaded end of conduit 16 and the outer nut 22 has a knurled outer periphery to facilitate the connection.

Mounted on body 12 is a metal shield 26 which acts as a shade and a reflector with respect to a light globe or bulb 30 placed in socket 14. A conventional wire protective cage 28 surmounts the shield 26 and provides for hanging of the trouble lamp by means of an integral hook 32.

The parts of the trouble lamp illustrated have been foreshortened to allow illustration of a desirable size within the space provided, but it is understood that such drawings are not to scale and, thus, the body 12 and its extension 18 as well as the socket 14 and conduit 16 would probably be much longer with respect to the width as shown to provide the amount of adjustment desired. Likewise the shield 26 and the cage 28 may be so proportioned that the light socket 14 may be extended as far as desired out of the reflective influence of the shield.

In the preferred embodiment, with the light socket in the fully retracted position, only a narrow spot of light is produced forward of the shield because the bulb is almost completely surrounded by the shield. With the lamp socket in a median position light is reflected to one side and when the bulb is forward of the shield and, in the fully extended position, the light will flood the area.

From the foregoing it is apparent that the subject device provides a source of light for the mechanic or car owner, for example, which may be adjusted according to the position of the work and the kind and amount of illumination desired.

Obviously other modifications and variations of the present invention are possible in shape, form and materials without deviating substantially from the above teachings.

I claim:

1. A trouble lamp comprising:

a hollow body member having opposed open ends;

a tubular shield mounted on said body member at one end thereof and a cylindrical cup shaped extension member telescopically mounted on the other end;

a socket for an electrical light bulb slidably mounted within said one end of said body member and having a rigid cylindrical conduit integral therewith and extending through said other end of said body member and said cup shaped extension member;

said cup shaped extension member having a bottom portion bored to receive said conduit;

fastening means integrally connecting said conduit to said bottom portion;

said shield having an inner portion wherein the bulb may be positioned to more or less completely rest beneath the rim of said said shield and a side portion which shields light from one side only; and said socket and conduit having outer surfaces complementary to inner surfaces of said body member and dimensioned for slip friction fit therebetween and permitting manipulation of said socket within said one end of said body between a fully extended position, a median side shielding position and a fully retracted position thereof.

* * * * *